US006266492B1

(12) United States Patent
Maehara

(10) Patent No.: US 6,266,492 B1
(45) Date of Patent: Jul. 24, 2001

(54) IMAGE FORMING APPARATUS WITH EXPENDABLE MEMBER AND RANDOM NUMBER GENERATOR

(75) Inventor: Shigeharu Maehara, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/604,971

(22) Filed: Jun. 28, 2000

(30) Foreign Application Priority Data

Jun. 28, 1999 (JP) ..... 11-181034

(51) Int. Cl.[7] ..... G03G 15/00
(52) U.S. Cl. ..... 399/12
(58) Field of Search ..... 399/12; 347/7

(56) References Cited

U.S. PATENT DOCUMENTS 4,690,545 9/1987 Maehara .
5,579,088 * 11/1996 Ko ..... 399/12
6,000,774 * 12/1999 Nambudiri ..... 347/7
6,155,664 * 12/2000 Cook ..... 347/7

FOREIGN PATENT DOCUMENTS 6-149051 5/1994 (JP) .

* cited by examiner

*Primary Examiner*—Joan Pendegrass

(57) ABSTRACT

An object of the invention is to provide an image forming apparatus capable of judging whether an expendable member such as a toner box mounted thereto is proper or not without reading all of specific information previously stored in a storing section of the expendable member. The image forming apparatus comprises a toner box removably mounted to a main body thereof, having an IC chip including a memory for storing the information specific to the toner box, and a CPU for judging whether a toner box mounted thereto is proper for the image forming apparatus or not. When a proper toner box is mounted to the main box for the first time, a random number is generated and stored in the memory of the IC chip and a memory of the main body, to carry out subsequent judgements of whether a toner box is proper or not using the random number.

4 Claims, 4 Drawing Sheets

IMAGE FORMING APPARATUS WITH EXPENDABLE MEMBER AND RANDOM NUMBER GENERATOR

BACKGROUND OF THE INVENTION

1. Field of the Invention

The present invention relates to an image forming apparatus comprising an expendable member for use in forming an image, which is removably mounted to a main body of the image forming apparatus, and provided with a storing section in which information specific to the expendable member is previously stored, and control means for judging whether the expendable member is proper or not based on the specific information previously stored in the storing section of the expendable member.

2. Description of the Related Art

In a conventional image forming apparatus, a developing apparatus is replenished with a developer in the following manner: when the ratio of a developer (T/D) in a developer tank of the developing apparatus decreases, the developer tank is replenished with a developer from a developer replenishing container, and the developer replenishing container is mounted to the image forming apparatus main body by the user.

In the case where a plurality of image forming apparatuses are placed close to each other, the kinds of developers used in the image forming apparatuses are often different. For example, even in the case where image forming apparatuses use the same photoconductors, the polarity of a developer used in an apparatus whose developing system is an analog system (regular rotation developing system) is opposite to the polarity of a developer used in an apparatus whose developing system is a digital system (reverse rotation developing system). Further, even in developers with the same polarity, the resistances of the developers depend on the components thereof (CCA, resin or the like) thereof due to electrification characteristics (saturation electrification amounts). Furthermore, in the case of an image forming apparatus which can form a color image, a developer used therein has a different hue.

In the case where the user mounts a developer replenishing container which contains a developer uninterchangeable among image forming apparatuses to a wrong image forming apparatus by mistake, a developing apparatus is replenished with a developer with different characteristics, and the developer with different characteristics causes a carrier rise and a developer burst. As a result, the developer scatters in the image forming apparatus, and a photoconductor is deteriorated.

In order to avoid such a problem, an image forming apparatus is proposed which comprises a developer replenishing container provided with a storing section which stores information specific to the developer replenishing container (information such as the kind of developer and the model of a proper image forming apparatus), and at the time of mounting a developer replenishing container to a developing apparatus of an image forming apparatus, it is judged whether the mounted developer replenishing container is proper or not based on the specific information stored in the storing section.

However, the image forming apparatus as described above has a problem that since all the specific information stored in the storing section are read when it is judged whether a mounted developer replenishing container is proper or not, even a developer replenishing container having been judged once needs to be judged to be proper or not based on all the specific information as well, and the judgement whether proper or not is not executed with efficiency.

SUMMARY OF THE INVENTION

An object of the present invention is to provide an image forming apparatus in which, once a judgement that an expendable member mounted to the image forming apparatus is proper therefor is formed, subsequent judgments of whether an expendable member is proper or not is carried out with ease by identifying the expendable member with the one which was once judged as being proper.

The invention provides an image forming apparatus comprising:

a main body having a storing section for storing a random number;

an expendable member for use in forming an image, removably mounted to the image forming apparatus main body, the expendable member being provided with a storing section in which information specific thereto is previously stored: and control means for judging whether or not an expendable member mounted to the image forming apparatus main body is proper for the image forming apparatus, based on the specific information, wherein, when an expendable member is mounted to the image forming apparatus, the control means judges the expendable member as being proper, the control means generates a random number, which random number is then stored in the storing section of the image forming apparatus main body and the storing section of the expendable member, and a subsequent judgment of an expendable member mounted to the image forming apparatus is first carried out by checking a match of random numbers of the storing sections of the image forming apparatus main body and expendable member by the control means, and in the case where the random number of the expendable member storing section matches with the random number of the storing section of the image forming apparatus main body, the expendable member is judged as being proper for the image forming apparatus.

According to the invention, the image forming apparatus comprises the expendable member for use in forming an image which is removably mounted to the image forming apparatus, and is provided with the storing section in which information specific to the expendable member is previously stored, and the control means in which when a judgement that an expendable member mounted to the image forming apparatus main body is proper for the image forming apparatus is formed for the first time, based on the specific information previously stored in the storing section, the control means generates a random number and causes the storing section of the expendable member and the storing section of the image forming apparatus main body to store the random number, subsequent judgments of whether an expendable member is proper or not is carried out, based on whether or not the random number in the storing section of the expendable member matches the random number in the storing section of the image forming apparatus main body. When the first judgment that the mounted expendable member is proper is formed, the control means generates a random number and executes a later judgement of an expendable member by using the random number, so that it is possible to judge with efficiency whether an expendable member is proper or not. Moreover, it is possible to judge with ease and reliability whether the expendable member is the same as the one mounted last time.

Further, in the invention it is preferable that when the random number in the storing section of the expendable member does not match the random number in the storing section of the image forming apparatus main body, the control means judges whether the expendable member is proper or not based on the specific information.

According to the invention, in the case where the random number in the storing section of the image forming apparatus main body does not match the random number in the storing section of the expendable member, the judgement of whether the expendable member is proper or not is then carried out based on the specific information previously stored in the storing section of the expendable member. Therefore, efficient and reliable judgment of whether an expendable member is proper or not.

In the invention it is preferable that the control means judges whether the expendable member mounted to the image forming apparatus is proper or not every time a power of the image forming apparatus main body is turned on.

According to the invention, the control means judges whether the expendable member mounted to the image forming apparatus is proper every time the power of the image forming apparatus main body is turned on, so that it is possible to judge with reliability whether the expendable member is proper or not before using the apparatus.

In the invention it is preferable that the expendable member is a developer replenishing container which contains a replenishing developer in order to replenish with the developer for use in forming an image; and when the developer replenishing container mounted to the image forming apparatus is judged as being improper, the control means controls the developer replenishing container so as not to replenish with the replenishing developer.

According to the invention, the expendable member is the developer replenishing container which contains a replenishing developer in order to replenish a developer tank with the developer for use in forming an image, and when the developer replenishing container mounted to the image forming apparatus main body is judged as being improper, the control means controls the developer replenishing container so as not to replenish the developer tank with the developer. Therefore, it is possible to prevent the developer tank from being replenished with a wrong developer.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
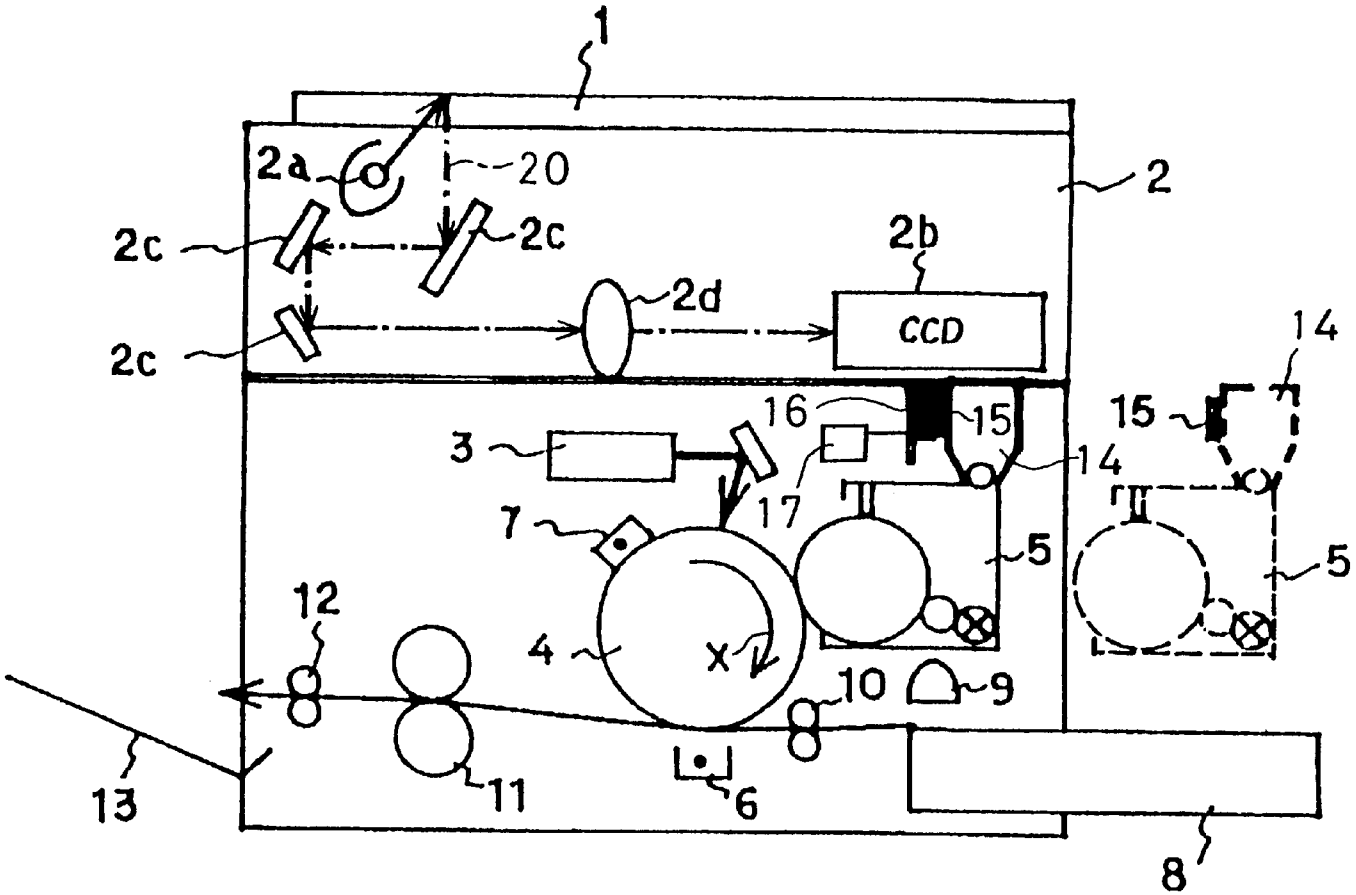
FIG. 1 is a schematic view showing the entire structure of an image forming apparatus of the present invention.

An embodiment of an image forming apparatus of the present invention will be illustrated referring to the drawings.

Figure 2:
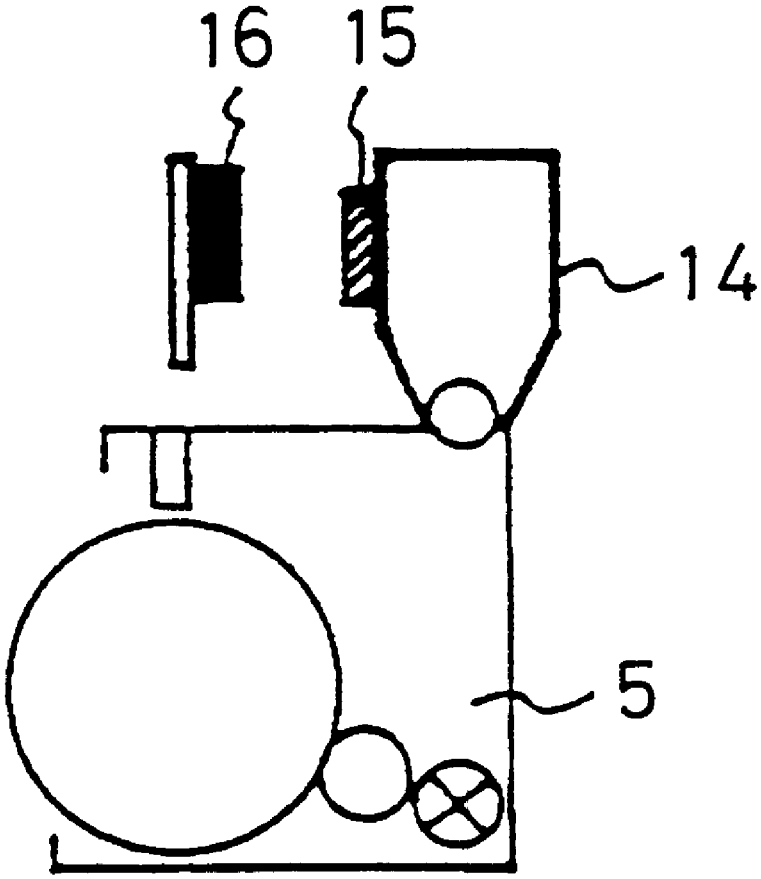
FIG. 2 is an enlarged view showing a developing section and a connector 16 of FIG. 1.

FIG. 1 is a schematic view showing the entire structure of an image forming apparatus of the invention. FIG. 2 is an enlarged view showing a developing section and a connector 16 of FIG. 1.

The image forming apparatus has a document plate 1 which is made of transparent glass or the like on an upper surface thereof as shown in FIG. 1, and a document reading section 2 disposed below the document plate 1, for reading an image of a document placed on the document plate 1.

The document reading section 2 includes an exposing light source 2*a* which irradiates a document placed on the document plate 1 with light, a reflection mirror 2*c* which guides reflected light 20 from the document to a charge-coupled device (CCD) 2*b* as shown by an alternate long and short dash line in FIG. 1, and an image forming lens 2*d* which forms the reflected light into an image at the CCD 2*b* on a light path between the reflection mirror 2*c* and the CCD 2*b*.

Document image data read by the CCD 2*b* of the document reading section 2 are subjected to image processing, and the surface of a photoconductor 4 is irradiated with laser light by a laser scanning unit (LSU) 3, whereby an electrostatic latent image is formed.

The photoconductor 4 is shaped like a drum which is driven to rotate in the direction of an arrow x in FIG. 1. Around the photoconductor 4, a developing apparatus 5 which develops an electrostatic latent image on the surface of the photoconductor 4 exposed by laser light to a visible image by toner working as a developer, a transfer charger 6 which transfers a toner image developed on the photoconductor 4 to a sheet of paper, a cleaning device (not shown) which removes toner residue on the surface of the photoconductor 4, a main charging unit 7 which charges the surface of the photoconductor 4 at a predetermined potential, and the LSU 3 are disposed in this order from a laser irradiation point by the LSU 3 in the rotating direction of the photoconductor 4.

A developing section including the developing apparatus 5 is mounted so as to be removable from a main body of the image forming apparatus as shown by a dashed line in FIG. 1.

Further, sheets of paper are housed in a paper-sheet cassette 8, and a pick-up roller 9 shaped like a half-moon which picks up sheets of paper one by one is disposed on the side of the front-end of the paper-sheet cassette 8. Toward the downstream side in the direction of conveying sheets of paper from the pick-up roller 9, a register roller 10 which feeds a picked-up sheet of paper while registering the sheet of paper and a toner image on the photoconductor 4, the transfer charger 6, a fixing device 11 which is composed of a pair of rollers for fixing a transferred toner image to a sheet of paper, a paper ejecting roller 12 which ejects a sheet of paper with a toner image fixed thereto outside the image forming apparatus, and an ejected-paper tray 13 on which ejected sheets of paper are stacked are mounted.

As shown in FIG. 2, a toner box 14 which serves as a developer replenishing container which contains toner for replenishing a developer tank is removably mounted to the developing apparatus 5, and the toner box 14 is provided with an IC chip 15. The developing apparatus 5 with the toner box 14 mounted thereto is mounted to the image forming apparatus by connecting the IC chip 15 of the toner box 14 with the connector 16 fixed to the image forming apparatus. The toner box 14 is electrically connected via the connector 16 with a CPU 17 working as control means mounted to the image forming apparatus main body.

Figure 3:
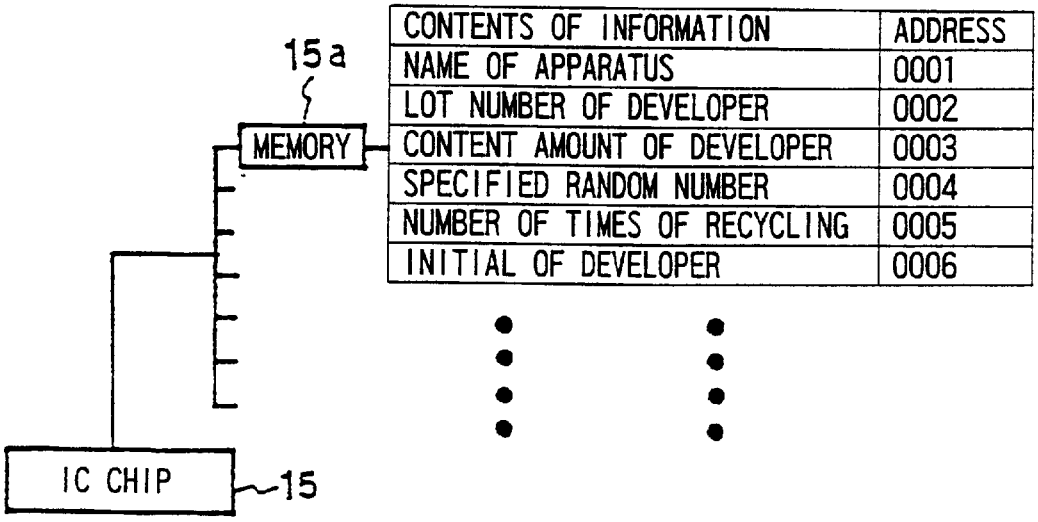
FIG. 3 is an explanation view showing specific information stored in a memory of an IC chip 15 of a developing apparatus in the image forming apparatus of the invention.

FIG. 3 is an explanation view showing specific information stored in a memory of the IC chip 15. As shown in FIG. 3, the IC chip 15 has a memory 15*a* which works as a storing section, and information specific to the toner box 14 are stored in the memory 15*a* so as to correspond to each address.

For example, the name (model name) and model number of an image forming apparatus which can use the toner box 14 is stored in an address 0001, the lot number of a developer contained in the toner box 14 is stored in an address 0002, the content amount of a developer contained in the toner box 14 is stored in an address 0003, and the number of times of recycling a container of the toner box 14 is stored in an address 0005 in advance. Moreover, information of an initial of a developer for judging whether or not the toner box 14 is the unused one is stored in an address 0006. In the address 0006, an initial indicating that the toner box 14 is the unused one is stored in advance until the toner box is used, and "in use" is written in by the CPU 17 when using the toner box is started.

In an address 0004, a random number generated by the CPU 17 of the image forming apparatus main body is written in as mentioned later.

Figure 4:
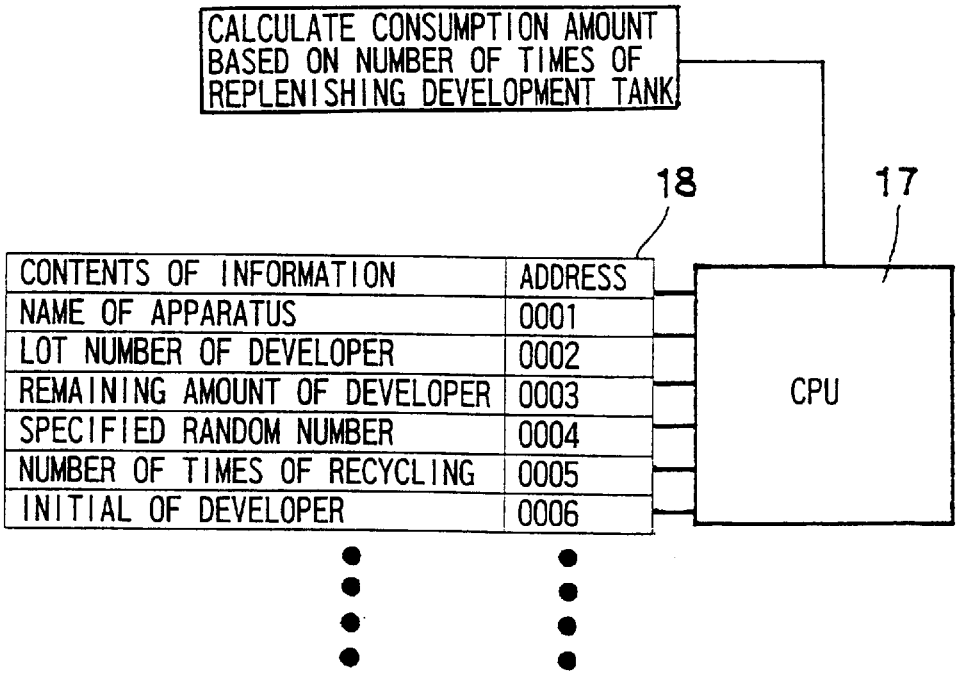
FIG. 4 is an explanation view showing specific information stored in a memory provided in a main body of the image forming apparatus of the invention.

FIG. 4 is an explanation view showing specific information stored in a memory of the image forming apparatus main body. In order that the CPU 17 of the image forming apparatus main body judges information of the toner box 14, the image forming apparatus main body is provided with a main memory 18 in which data read from the IC chip 15 are written and data on the image forming apparatus main body are stored in advance as shown in FIG. 4.

In the main memory 18, for example, the name (model name) and model number of the image forming apparatus is previously stored in an address 0001, the lot number of a developer read from the memory 15*a* of the IC chip 15 is written in an address 0002, the remaining amount of the developer calculated based on the content amount of the developer read from the memory 15*a* of the IC chip 15 is written in an address 0003, a specified random number generated by the CPU 17 so as to be written in the memory 15*a* of the IC chip 15 are written in an address 0004, and information such as the number of times of recycling allowable for the toner box 14 mounted to the image forming apparatus is written in an address 0005. Further, an initial of the developer indicating information of "in use" which has been written by the CPU 17 when using the toner box 14 is started, that is, when the specified random number is stored in the address 0004, is written in an address 0006.

The CPU 17 judges whether or not the mounted toner box 14 is proper for the image forming apparatus based on the information stored in the respective addresses of the memory 15*a* and the main memory 18.

The CPU 17 judges whether or not the name of an apparatus stored in the address 0001 of the main memory 18 of the image forming apparatus main body is included in the names of available apparatuses read from the address 0001 of the memory 15*a* of the IC chip 15. When the CPU judges from the result that the name of an apparatus is included, a display panel (not shown) displays that the mounted toner box 14 is proper for the image forming apparatus, whereas when the name of an apparatus is not included, the display panel displays that the mounted toner box is improper. Moreover, the CPU 17 judges whether or not the number of times of recycling previously stored in the address 0005 of the memory 15*a* excesses the allowable number of times of recycling stored in the address 0005 of the main memory 18, and when the number excesses, the display panel displays that the toner box 14 is improper.

Further, the CPU 17 calculates the remaining amount of a developer by subtracting the consumed amount of toner found from the rotation number of a toner supply roller of the toner box 14 and so on from an initial value which is the content amount of the developer read from the address 0003 of the memory 15*a* of the IC chip 15. When the consumed amount increases and the apparatus becomes in the state of toner empty, this is displayed on the display panel and replacement of the toner box 14 is encouraged.

Furthermore, when judging the toner box 14 mounted as mentioned before to be proper for the image forming apparatus, the CPU 17 generates a random number and writes the generated random number in the address 0004 of the main memory 18 and the address 0004 of the memory 15*a* of the IC chip 15. While the toner box 14 mounted to the image forming apparatus main body main body and judged to be proper is in use, the random number is used whenever necessary to specify the toner box 14.

Still further, when judging the toner box 14 mounted as mentioned before to be proper for the image forming apparatus, the CPU 17 generates a random number and writes the generated random number in the address 0004 of the memory 15*a* of the IC chip 15. While the toner box 14 mounted to the image forming apparatus main body and judged to be proper is in use, the random number is used whenever necessary to specify the toner box 14.

In other words, the CPU 17 judges whether the toner box 14 is proper or not every time the power of the image forming apparatus main body is turned on. When the power is turned on after a random number is generated once, the CPU 17 judges whether or not the random number written in the address 0004 of the main memory 18 matches the random number written in the address 0004 of the memory 15*a*. When these random number written in the address 0004 of the main memory 18 matches the it is ensured that the toner box 14 is proper.

Figure 5:
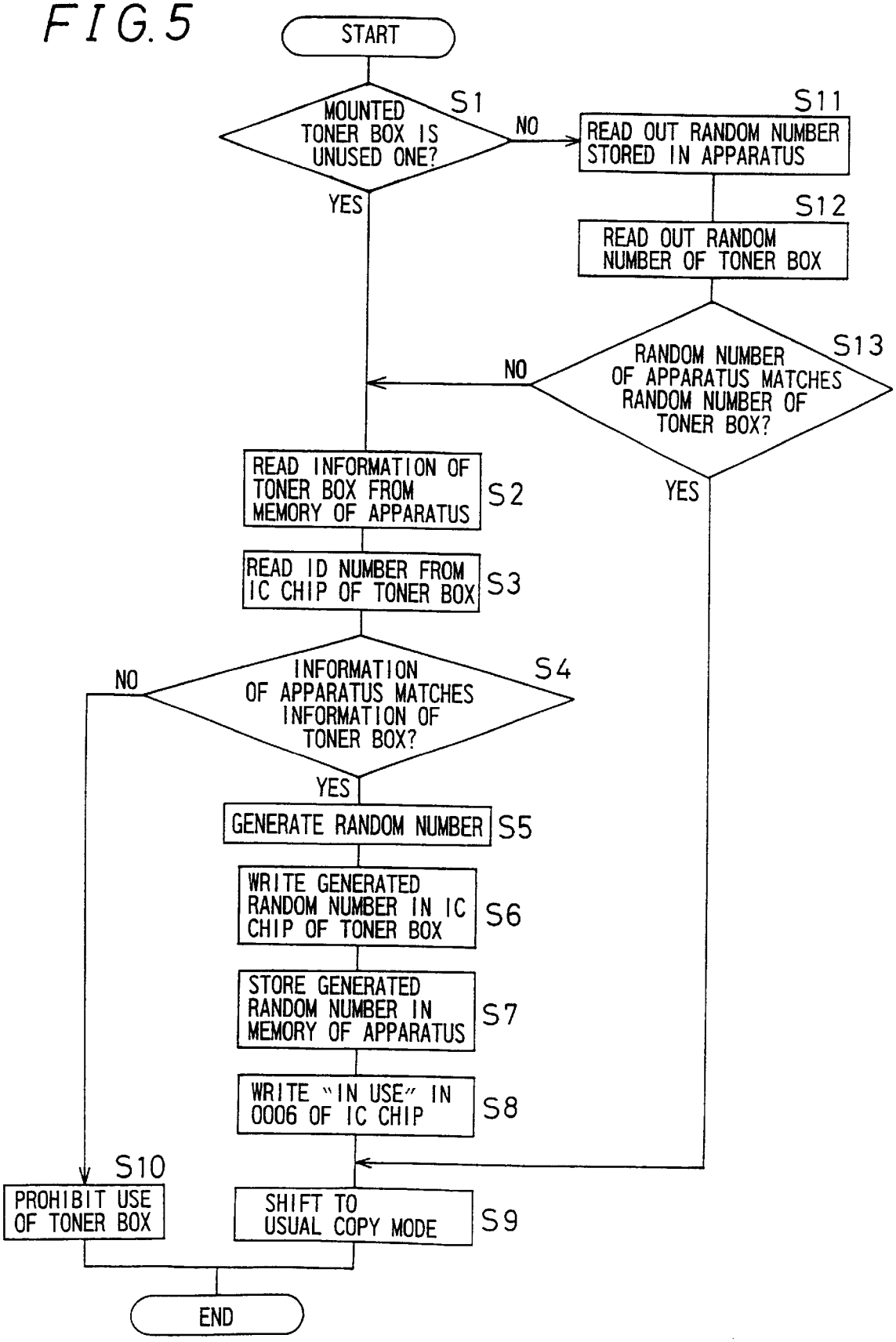
FIG. 5 is a flow chart showing a judgement operation by a CPU 17 whether a toner box is proper or not in the image forming apparatus of the invention.

FIG. 5 is a flow chart showing a judgement operation by the CPU 17 whether the toner box 14 is proper or not. A judgement operation whether the toner box 14 is proper or not in the image forming apparatus of the above construction will be explained by the flow chart of FIG. 5. The judgement operation whether the toner box 14 is proper or not will be explained by separating the case where an unused toner box 14 is mounted to the image forming apparatus main body and the case where a toner box 14 in use is mounted to the image forming apparatus main body.

First, the power of the image forming apparatus main body is turned on, whereby the judgement operation is started. The CPU 17 judges whether or not the mounted toner box 14 is the unused one based on the information stored in the address 0006 of the memory 15*a* (S1). Since in the case where an unused toner box 14 is mounted to the image forming apparatus main body, an initial indicating that the toner box 14 is the unused one is previously stored in the address 0006 of the memory 15*a*, the CPU 17 judges the mounted toner box to be unused. When judging unused, the CPU 17 reads information on a condition to be satisfied by a mounted toner box out of the main memory 18 of the image forming apparatus main body (S2). Then, the CPU 17 reads out the information on the toner box 14 stored in a predetermined address of the memory 15*a* of the IC chip 15 of the toner box 14 (S3). Then, based on the information read out of the main memory 18 and the memory 15*a*, the CPU judges whether or not the information of the image forming apparatus main body and the information of the toner box (except the remaining amount of toner) match each other (S3), and when match, the CPU judges the mounted toner box 14 to be proper for the image forming apparatus main.

In the case where the mounted toner box 14 is judged to be proper for the image forming apparatus, a random number needs to be written in because the toner box 14 has never been used since mounted. Therefore, the CPU 17 generates a random number (S5) and writes the random number in the memory 15*a* of the IC chip 15 of the toner box 14 (S6). Then, the CPU also stores the random number in the main memory 18 of the image forming apparatus main body (S7) and writes "in use" in the address 0006 of the memory 15*a* of the IC chip 15 (S8). Since preparation for copying is thereby completed, the operation shifts to a usual copy mode (S9) to finish the judgement operation by the CPU 17 whether the toner box 14 is proper or not.

On the other hand, when judging at step S3 that the information of the image forming apparatus main body does not match the information of the toner box, the CPU judges that the mounted toner box 14 is an improper toner box for the image forming apparatus and prohibits the use of the toner box 14 (S10), thereby finishing the judgement operation by the CPU 17 whether the toner box 14 is proper or not.

Further, in the case where a toner box 14 in use is mounted to the image forming apparatus main body, as in the case where an unused toner box 14 is mounted, the power is turned on to start the judgement operation and the CPU judges whether or not the toner box 14 is the unused one (S1). Since "in use" has been written in the address 0006 of the memory 15*a* in the case where a toner box 14 in use is mounted to the image forming apparatus main body, the CPU 17 judges that the mounted toner box 14 is not the unused one.

In the case where the toner box 14 is not the unused one, the toner box 14 is in use, that is, the developer tank of the developing apparatus has been replenished with toner several times since the toner box is mounted to the image forming apparatus main body, and therefore a random number has been written in the addresses of the main memory 18 and the memory 15*a*. Based on whether these random numbers match or not, the CPU judges whether or not the toner box 14 is the same as the one mounted before. In order to judge whether or not the toner box 14 is the same as the one mounted before, the CPU reads out the random number stored in the main memory 18 of the image forming apparatus main body (S11), also reads out the random number stored in the memory 15*a* of the IC chip 15 of the toner box 14 (S12), and judges whether or not the random number of the image forming apparatus and the random number of the toner box 14 match each other (S13). When matching, the toner box 14 is the same as the one mounted before and it has no problem in copy operation, so that the operation shifts to S9 of a usual copy mode to finish the judgement operation.

However, in the case where the random number of the image forming apparatus and the random number of the toner box 14 do not match each other at step S13, the toner box mounted at present is different from the one mounted before. Therefore, the operation goes to step S2, and as in the case where an unused toner box 14 is mounted to the image forming apparatus main body, it is necessary to judge whether or not the information of the image forming apparatus main body and the information of the toner box 14 match each other based on the information read out of the main memory 18 and the memory 15*a* (S4), and judge whether or not the mounted toner box 14 is proper for the image forming apparatus. The later judgement operation in accordance with the judgement result is the same as in the case where an unused toner box 14 is mounted to the image forming apparatus main body.

In the case where the random number of the image forming apparatus and the random number of the toner box 14 do not match each other at step S13, the operation may go to step S10 to prohibit the use of the toner box 14.

As described above, according to the embodiment of the image forming apparatus of the invention, a toner box which is an expendable member removably mounted to the image forming apparatus main body is provided with a storing section for storing information specific to the expendable member, and when an expendable member is first mounted to the image forming apparatus main body and the expendable member is judged to be proper for the apparatus based on the specific information, a generated random number is stored in the storing section of the expendable member and a storing section of the image forming apparatus main body. Therefore, in a later judgement whether an expendable member is proper or not, based on not the specific information but whether or not the random number of the storing section of the expendable member matches the random number of the storing section of the image forming apparatus main body, it is possible to judge with efficiency whether the expendable member is proper or not, and moreover it is possible to judge with ease and reliability whether or not the expendable member is the same one as mounted last time.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a main body having a storing section for storing a random number;

an expendable member for use in forming an image, removably mounted to the image forming apparatus main body, the expendable member being provided with a storing section in which information specific thereto is previously stored: and control means for judging whether or not an expendable member mounted to the image forming apparatus main body is proper, based on the specific information, wherein, when an expendable member is mounted to the image forming apparatus main body, the control means judges the expendable member as being proper, the control means generates a random number, which random number is then stored in the main body storing section and the storing section of the expendable member, and a subsequent judgment of an expendable member mounted to the image forming apparatus main body is first carried out by checking a match of random numbers of the main body storing section and expendable member storing section by the control means, and in the case where the random number of the expendable member storing section matches with the random number of the main body storing section, the expendable member is judged as being proper for the image forming apparatus.

2. The image forming apparatus of claim 1, wherein when the random number in the storing section of the expendable member does not match the random number in the storing section of the image forming apparatus main body, the control means judges whether the expendable member is proper or not based on the specific information.

3. The image forming apparatus of claim 1, wherein the control means judges whether the expendable member mounted to the image forming apparatus main body is proper or not every time a power of the main body is turned on.

4. The image forming apparatus of claim 1, wherein the expendable member is a developer replenishing container which contains a replenishing developer in order to replenish with the developer for use in forming an image; and when the developer replenishing container mounted to the image forming apparatus main body is judged as being improper, the control means controls the developer replenishing container so as not to replenish with the replenishing developer.

* * * * *